US008347554B2

(12) United States Patent
Uto et al.

(10) Patent No.: US 8,347,554 B2
(45) Date of Patent: Jan. 8, 2013

(54) HINGE AND DOOR UNIT

(75) Inventors: Ryoji Uto, Tokyo (JP); Takahiro Goto, Kobe (JP)

(73) Assignee: Caterpillar SARL, Geneva (CH)

( * ) Notice: Subject to any disclaimer, the term of this patent is extended or adjusted under 35 U.S.C. 154(b) by 141 days.

(21) Appl. No.: 13/121,476

(22) PCT Filed: Aug. 6, 2010

(86) PCT No.: PCT/JP2010/063377

§ 371 (c)(1),
(2), (4) Date: Mar. 29, 2011

(87) PCT Pub. No.: WO2011/024628

PCT Pub. Date: Mar. 3, 2011

(65) Prior Publication Data

US 2011/0185637 A1 Aug. 4, 2011

(30) Foreign Application Priority Data

Aug. 27, 2009 (JP) ..... 2009-196811

(51) Int. Cl.
*E05D 11/06* (2006.01)
*E06B 3/36* (2006.01)
*E05C 17/22* (2006.01)

(52) U.S. Cl. ..... 49/381; 49/394; 49/397

(58) Field of Classification Search ..... 49/381, 49/394, 397; 16/350, 351, 362, 363; 296/146.11
See application file for complete search history.

(56) References Cited

U.S. PATENT DOCUMENTS 3,933,383 A * 1/1976 Walker ..... 292/262
3,967,850 A * 7/1976 Whisler ..... 296/146.1
3,969,789 A * 7/1976 Wize ..... 16/297
4,263,853 A * 4/1981 Robertson ..... 105/378
4,470,170 A * 9/1984 Gerteis ..... 16/345
4,700,983 A * 10/1987 Kinaga et al. ..... 296/146.11
4,700,984 A * 10/1987 Kinaga et al. ..... 296/146.11
5,673,459 A * 10/1997 Baghdasarian ..... 16/308
6,175,991 B1 * 1/2001 Driesman et al. ..... 16/366
6,817,063 B1 * 11/2004 Nania ..... 16/334
7,032,953 B2 * 4/2006 Rangnekar et al. ..... 296/146.11
7,137,662 B2 * 11/2006 Nakayama et al. ..... 296/190.11
7,255,189 B2 * 8/2007 Kurtz et al. ..... 180/68.4
7,806,214 B2 * 10/2010 Tsukui et al. ..... 180/89.17
8,240,415 B2 * 8/2012 Okada et al. ..... 180/89.17
2010/0103601 A1 * 4/2010 Wang et al. ..... 361/679.02
2010/0301631 A1 * 12/2010 Scott et al. ..... 296/146.12
2011/0030280 A1 * 2/2011 Kaita et al. ..... 49/394
2011/0126469 A1 * 6/2011 Uto et al. ..... 49/397

FOREIGN PATENT DOCUMENTS

JP 9-315347 A 12/1997

(Continued)

*Primary Examiner* — Katherine W Mitchell
*Assistant Examiner* — Justin Rephann
(74) *Attorney, Agent, or Firm* — McDermott Will & Emery LLP

(57) ABSTRACT

A hinge enabling a plurality of hold-stay members to automatically lock when the door is fully open, increasing the durability of the hinge, and enabling easy release of the hold-stay members. A hinge includes a one-side hinge plate, a plurality of opposing-side hinge plate portions provided along the lengthwise direction of the hinge plate and supported by it, and an open-angle limiting mechanism for stopping, at a specific angle, opening movement of the opposing-side hinge plate portions.

4 Claims, 12 Drawing Sheets

FOREIGN PATENT DOCUMENTS

| | | | |
|---|---|---|---|
| JP | 11-270211 | A | 10/1999 |
| JP | 2001-107627 | A | 4/2001 |
| JP | 3564093 | B2 | 9/2004 |
| JP | 2008-196134 | A | 8/2008 |
| JP | 2009-113658 | A | 5/2009 |
| JP | 2009-174222 | A | 8/2009 |

* cited by examiner

HINGE AND DOOR UNIT

CROSS REFERENCE TO PRIOR APPLICATIONS

This application is a U.S. National Phase application under 35 U.S.C. §371 of International Application No. PCT/JP2010/063377, filed on Aug. 6, 2010 and claims benefit of priority to Japanese Patent Application No, 2009-196811, filed on Aug. 27, 2009. The International Application was published in Japanese on Mar. 3, 2011 as WO 2011/024628 A1 under PCT Article 21(2). All of these applications are herein incorporated by reference.

TECHNICAL FIELD

The present invention relates to a hinge for attaching a door panel to a frame. The invention also relates to a door unit that can be opened and closed freely by means of the hinge.

BACKGROUND OF THE INVENTION

FIG. 11 illustrates a hydraulic excavator 10, which is a work machine. The hydraulic excavator 10 includes a lower structure 11, an upper structure 12, a cab 13, a work equipment 14, and a power system 15 that includes an engine. The cab 13, the work equipment 14, and the power system 15 are mounted on the upper structure 12, which is rotatably mounted on the lower structure 11. The power system 15 is covered by a top cover 16, side doors 17, and other such components. Each side door 17 is attached, by hinges 18 so as to be freely openable and closable. The side door 17 is provided with a holding mechanism 19, which is illustrated in FIGS. 12 to 14 and serves to keep the side door 17 open.

When the side door 17 is closed, the conventional holding mechanism 19 illustrated in FIGS. 12 to 14 is stowed as illustrated in FIG. 13 in such a manner that a U-shaped hold-stay or rod 19*s* bridges respective holes of brackets 19*a*,19*b*, which are attached to an upper structure frame 12*f*. When the side door 17 is open, the hold-stay or rod 19*s* is hooked in the hole of the bracket 19*a*, which is attached to the upper structure frame 12*f*, and a hole of a bracket 19*d*, which is attached to the inner surface of the side door 17, so that the hold-stay or rod 19*s* bridges the bracket 19*a* and the bracket 19*d* as illustrated in FIG. 14 (e. g. see Japanese Laid-open Patent Publication No. 9-315347 (p 4, and FIG. 4) and Japanese Laid-open Patent Publication No. 2001-107627 (p 4, and FIG. 1) ("JP '627")).

At that time, the side door 17 is locked in the open position by manually operating a single hold-stay or rod 19*s*. As a side door of a work machine is prone to bouncing back from the fully open position when it is opened, it is desirable from the perspective of better safety that the hold-stay or rod be automatically operated to be in the locked position.

In case of a structure for opening and closing the engine hood of a work machine, it is possible to provide the structure with a mechanism for automatically locking a hold-stay (e. g. see Japanese Laid-open Patent Publication No. 2009-113658 (pp 9-10, and FIGS. 7-9)). However, such a structure cannot be applied to a side door without modification.

According to the conventional structure, the side door 17 is locked in the open position by manually operating a single hold-stay or rod 19*s*. Therefore, in cases where the side door 17 is wide or heavy, an inadvertent or otherwise application of a force in such a direction as to close the door when the hold-stay or rod 19*s* is still in the locked position may deform the hold-stay or rod 19*s*, because the single hold-stay or rod 19*s* is unable to bear the force. On the other hand, should an attempt be made to open the door wider than the angle at which the door is stopped, a hinge plate described in JP '627 or other component may become deformed. Therefore, it is necessary to improve the durability of the hinge plate or such other components.

It is easy to provide each of the upper and lower hinges with a hold-stay or rod described in JP '627 if only for the purpose of improving the durability. However, as the vertical dimension of a work machine is large, it often happens that an operator cannot reach the hold-stay or rod of the upper hinge and has to prepare a ladder or the like, resulting in reduced working efficiency.

In order to solve the above problems, an object of the invention is to provide a hinge that enables a plurality of hold-stay members to be automatically locked when the door is fully open, thereby increasing the durability of the hinge, and also enables easy releasing of the plurality of hold-stay members. Another object of the invention is to provide a door unit equipped with this hinge.

SUMMARY OF THE INVENTION

The present invention relates to a hinge that includes a plurality of one-side hinge plate portions at one side of the hinge; a plurality of opposing-side hinge plate portions provided at the opposing side of the hinge and supported by the one-side hinge plate portions so as to be freely openable and closable; and an open-angle limiting mechanism provided so as to bridge the opposing-side hinge plate portions to the one-side hinge plate portions and stop opening movement of the opposing-side hinge plate portions at a specific angle with respect to the one-side hinge plate portions. The open-angle limiting mechanism includes mounting plate portions respectively provided at the one-side hinge plate portions as an integral body therewith; a plurality of guide members respectively provided at the mounting plate portions; a plurality of lock members that are shorter than the guide members and respectively provided in proximity to the guide members; a plurality of bracket portions respectively provided at the opposing-side hinge plate portions as an integral body therewith and having shaft holes; a rod rotatably inserted through the shaft holes of the bracket portions in such a manner as to be capable of sliding in the axial direction; and a plurality of hold-stay members integrally connected to the rod. Each one of the plurality of hold-stay members has a fitting portion and a catching portion. The fitting portions of the hold-stay members are adapted to respectively fit to the guide members and, in this state, slide as a result of opening or closing operation of the opposing-side hinge plate portions with respect to the one-side hinge plate. The catching portions are adapted to engage with or disengage from the lock members as a result of axial movement of the rod when the opposing-side hinge plate portions are at the maximum-open position with respect to the one-side hinge plate portions.

The hinge above can include a one-side hinge plate having an elongated shape; the plurality of one-side hinge plate portions are formed as an integral body with the one-side hinge plate; and the plurality of mounting plate portions are formed as an integral body with the one-side hinge plate, respectively at a plurality of locations in the lengthwise direction of the one-side hinge plate.

The present invention is further characterized in that each of the guide members and lock members has a pin-like shape and that the fitting portions and the catching portions of the hold-stay members have a slit-like shape and a notch-like shape, respectively.

The present invention can also relate to a door unit including a door panel and a hinge for attaching one end of the door panel to a frame and having a structure according to any described above, wherein the door panel includes an outer panel, an inner panel affixed to the inner surface of the outer panel so that a space is formed between the outer panel and the inner panel, and a foamed material filling the space between the outer panel and the inner panel.

According to the present invention, the open-angle limiting mechanism serves to stop, at a specific angle, opening movement of the plurality of opposing-side hinge plate portions supported by the plurality of one-side hinge plate portions so as to be freely openable and closable. The mounting plate portions are respectively provided at the plurality of one-side hinge plate portions as an integral body therewith. The bracket portions are respectively provided at the plurality of opposing-side hinge plate portions as an integral body therewith. The open-angle limiting mechanism is provided with a plurality of hold-stay members, each of which extends between each mounting plate portion and the corresponding bracket portion. Therefore, even if the door is wide or heavy, the plurality of hold-stay members are capable of supporting the force that is applied, in such a direction as to open or close the door without being deformed, resulting in an improved durability of the hold-stay members. Furthermore, these hold-stay members are integrally connected to the rod, which is rotatably inserted through the shaft holes of the plurality of bracket portions in such a manner as to be capable of sliding in the axial direction. Therefore, the upper hold-stay member, which is difficult to reach, can easily be released from the locked position by operating, for example, the bottom of the rod or the lower hold-stay member in the axial direction of the rod. A particular benefit of the present invention lies in that the plurality of hold-stay members are provided with the fitting portions and the catching portions, wherein the fitting portions are adapted to respectively fit to the guide members and, in this state, slide as a result of opening or closing operation of the opposing-side hinge plate portions with respect to the one-side hinge plate; and axial movement of the rod when the opposing-side hinge plate portions are at the maximum-open position with respect to the one-side hinge plate portions causes the catching portions to engage with or disengage from the lock members, which are respectively provided in the proximity of the guide members and shorter than the guide members. With the structure as above, the catching portions of the plurality of hold-stay members are capable of automatically engaging with the plurality of lock members at the aforementioned maximum-open position, thereby automatically maintaining the fully-open position. Furthermore, this structure also makes it possible to simultaneously move the plurality of hold-stay members in the axial direction so as to disengage the hold-stay members from the plurality of lock members by means of a single rod. Therefore, the structure described above facilitates engagement and disengagement of the plurality of hold-stay members.

Also, by using the one-side hinge plate having an elongated shape, the plurality of one-side hinge plate portions are formed as an integral body, and the plurality of mounting plate portions are provided as an integral body with the one-side hinge plate, respectively at a plurality of locations in the lengthwise direction of the one-side hinge plate. With the configuration as above, the plurality of one-side hinge plate portions can be fastened easily without the need of adjusting the relative positions therebetween.

Further, the open-angle limiting mechanism can easily be produced, because the pin-shaped guide members and lock members, the slit-shaped fitting portions, and the notch-shaped catching portions simplify the structure of the open-angle limiting mechanism.

Additionally, as the space between the outer panel and the inner panel is filled with the foamed material in order to make the door panel lighter as well as improve the vibration absorbing ability of the door panel, the burden imposed on the hinge is reduced, resulting in improved durability of the hinge.

DETAILED DESCRIPTION OF THE INVENTION

Next, the present invention is explained in detail hereunder, referring to an example thereof shown in FIGS. 1 to 9.

Figure 9:
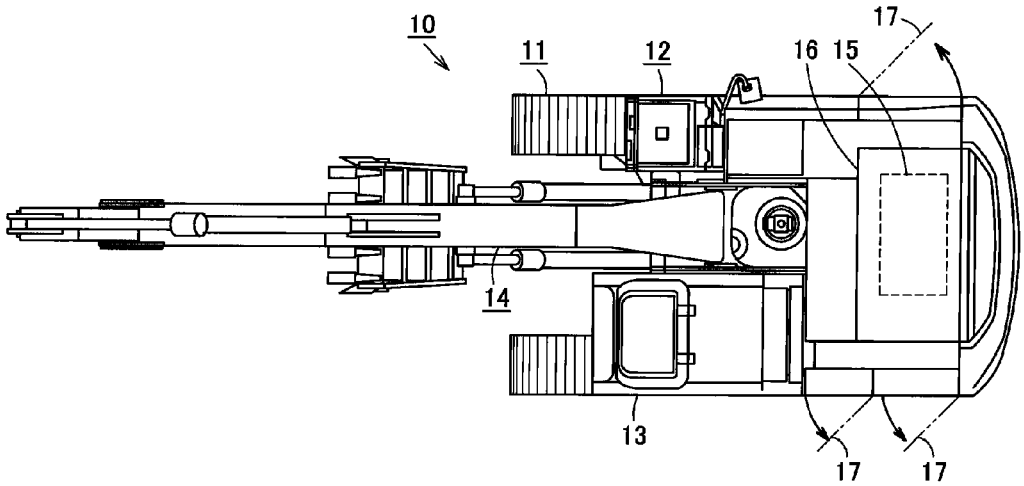
FIG. 9 is a plan view of a work machine equipped with the door unit.

FIG. 9 illustrates a hydraulic excavator 10, which is a work machine. The hydraulic excavator 10 includes a lower structure 11, an upper structure 12, a cab 13, a work equipment 14, and a power system 15 that includes an engine. The cab 13, the work, equipment 14, and the power system 15 are mounted on the upper structure 12, which is rotatably mounted on the lower structure 11. The power system 15 is covered, by a top cover 16, side doors 17, and other such components.

FIGS. 3 to 6 illustrate a door panel 20 of a side door 17. The door panel 20 includes an outer panel 21, an inner panel 23, and a foamed material 24. The inner panel 23 is formed by means of press molding so as to have an uneven surface with recessed portions and raised portions. The recessed portions are fixed to the inner surface of the outer panel 21, and a space 22 is formed between the raised portions and the outer panel 21 and filled with the aforementioned foamed material 24.

Four ventilation openings 25 arranged one above another are formed, in each panel, i.e. the outer panel 21 and the inner panel 23.

The outer panel 21 has a thickness ranging from 1.2 to 5.0 times that of the inner panel 23. In other words, an iron plate that is thinner than the outer panel 21 is used to form the inner panel 23. For example, if the outer panel 21 is an iron plate with a thickness of 1.2 mm, it is desirable to use a thin iron plate with a thickness of, for example, 0.6 or 0.8 mm to form the inner panel 23 in order to obtain sufficient strength and workability, which are reciprocal properties.

The foamed material 24 is formed by heating an unactivated foaming sheet of a foaming material, which is attached to the inner surface of the outer panel 21 or the inner surface of the inner panel 23, so that the heated foaming material is activated and expands inside the space 22 between the outer panel 21 and the inner panel 23, A highly expandable foaming rubber-base sound absorbing material that has an approximately 20-fold volumetric thermal expansion coefficient may desirably be used as the foaming material. It is desirable to conduct the heating of the foaming material during the baking finish process using a baking finish heating furnace.

Figure 5:
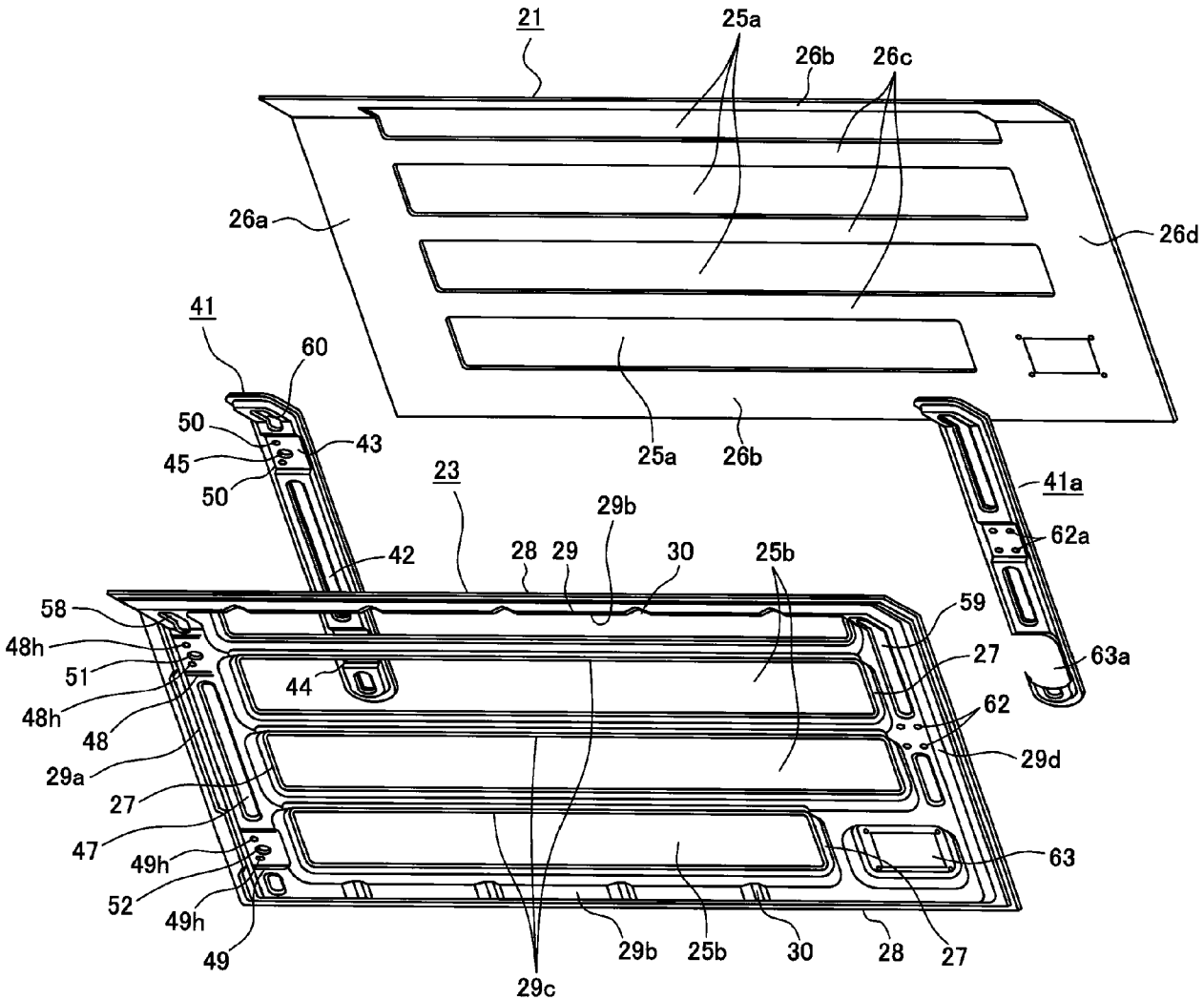
FIG. 5 is an exploded perspective view of the door panel.

As illustrated in FIG. 5, the outer panel 21 includes a panel portion 26*a* located at the hinge-attaching end, i.e. the end to which a hinge is attached; laterally extending panel portions 26*b*, which are respectively located at the top and the bottom of the outer panel 21; laterally extending panel portions 26*c*, which are respectively the second, third, and fourth panel portions from the top; a panel portion 26*d* located, at the lock mechanism-attaching end, i.e. the end to which a lock mechanism is attached; and ventilation openings 25*a* open between these panel portions 26*a*, 26*b*, 26*c*, 26*d*.

The inner panel 23 has adhering portions 27, 28, which are the aforementioned recessed portions joined to the inner surface of the outer panel 21, and a raised portion 29 bulging from, the adhering portions 27, 28. The adhering portions 27 surround the ventilation openings 25. The adhering portion 28 extends along the peripheral edge of the inner panel 23.

The raised portion 29 of the inner panel 23 is formed of a vertically extending reinforcing raised portion 29*a*, laterally extending reinforcing raised portions 29*b*, crossbar-shaped reinforcing raised portions 29*c*, and a vertically extending reinforcing raised portion 29*d*. The reinforcing raised portion 29*a* has a large cross section and is formed at the hinge-attaching end of the inner panel 23. Of the laterally extending reinforcing raised portions, the reinforcing raised portions 29*b* have a large cross section and are respectively located at the top and the bottom, whereas the crossbar-shaped reinforcing raised portions 29*c* are respectively the second, third, and fourth laterally extending reinforcing raised portions from the top and have a smaller cross section. The reinforcing raised portion 29*d* has a large cross section and is formed at the lock mechanism-attaching end of the inner panel 23.

The reinforcing raised portion 29*a* at the hinge-attaching end, the laterally extending reinforcing raised portions 29*b* at the top and the bottom, and the reinforcing raised portion 29*d* at the lock mechanism-attaching end together constitute a frame-like reinforcing raised portion 29*a*, 29*b*, 29*d*, which is formed by bulging the peripheral portion, of the inner panel 23 in a direction away from the outer panel 21. The three laterally extending crossbar-shaped reinforcing raised portions 29*c* are formed, integrally with, and surrounded by this frame-like reinforcing raised portion 29*a*, 29*b*, 29*d*, in other words, within a boundary defined by the frame-like reinforcing raised portion 29*a*, 29*b*, 29*d*.

Figure 6:
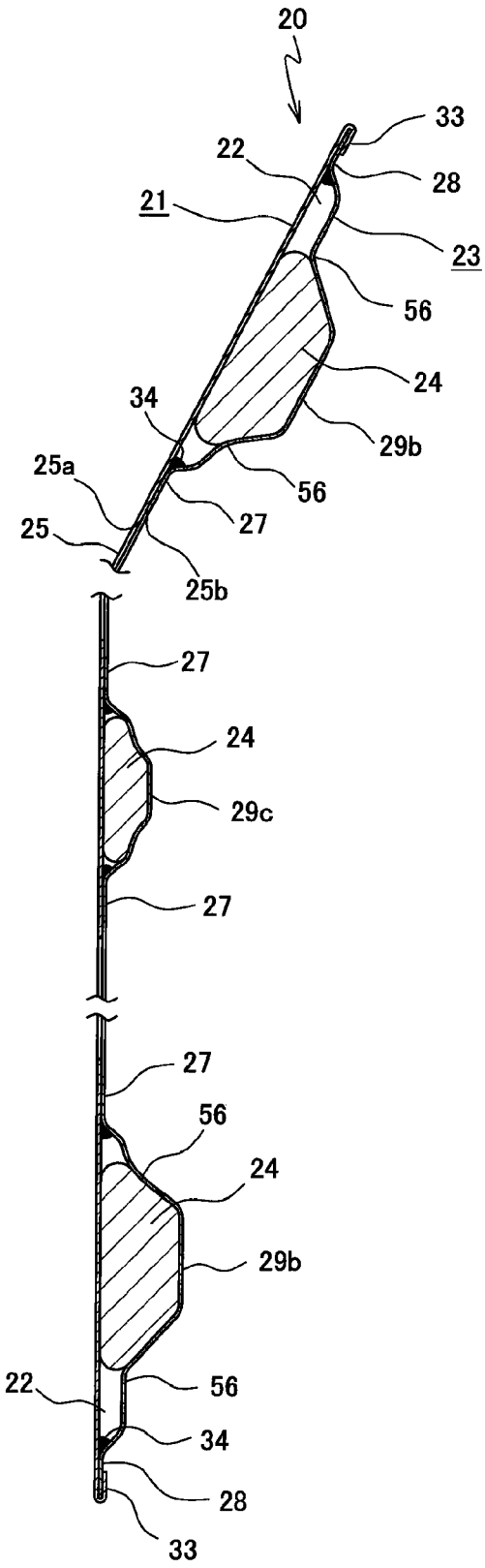
FIG. 6 is a sectional view of the door panel taken along the line VI-VI of FIG. 4.

Each of the reinforcing raised portions 29*b*, which respectively serve as the top and the bottom reinforcing raised portions, is thick and provided with reinforcing indentations 30 that are formed vertically across the reinforcing raised portion 29*b*. As illustrated in FIG. 6, in order to ensure a sufficient aperture area for the ventilation openings 25, each crossbar-shaped reinforcing raised portion 29*c* with a smaller cross section is formed narrower as well as lower than each reinforcing raised portion 29*b* and is not provided with a reinforcing indentation 30 unlike the reinforcing raised portions 29*b*.

The adhering portions 27 of the inner panel 23 are provided, with ventilation openings 25*b*, which are provided at locations respectively corresponding to the three ventilation openings 25*a* formed in the outer panel 21. Each ventilation opening 25*b* is slightly larger than the corresponding ventilation opening 25*a* of the outer panel 21.

The outer peripheral edge of the outer panel 21 is provided with a hemmed portion 33 that is formed by folding the outer peripheral edge of the outer panel 21 so as to curl over the peripheral edge of the inner panel 23 and then pressing down the folded part substantially flat so that the outer peripheral edge of the outer panel 21 interlocking secures the peripheral edge of the inner panel 23. The adhering portions 27, 28 of the inner panel 23 are bonded to the outer panel 21 with an adhesive 34, which joins as well as seals the outer panel 21 and the adhering portions 27,28 of the inner panel 23 together. The adhesive 34 may desirably be a paste-type structural adhesive having both viscous and thermosetting properties.

As illustrated in FIG. 5, an internal reinforcing plate 41 for mounting the hinge and an internal reinforcing plate 41*a* for mounting the lock mechanism are sandwiched between the outer panel 21 and the inner panel 23 in the state where the inner panel 23 is positioned on and affixed to the inner surface of the outer panel 21. The internal reinforcing plates 41, 41*a* are affixed to the outer panel 21 and the inner panel 23 by means of an adhesive or the like.

To be more specific, the inner panel 23 has such a structure that the frame-like reinforcing raised portion 29*a*, 29*b*, 29*d*, which includes the reinforcing raised portion 29*a* at one lateral end of the inner panel 23 and the reinforcing raised portion 29*d* at the opposing lateral end of the inner panel 23, and bulges in a direction away from the outer panel 21; a plurality of crossbar-shaped reinforcing raised portions 29*c* are formed within a boundary defined by the frame-like reinforcing raised portion 29*a*, 29*b*, 29*d*; and that the ventilation openings 25*b* are provided between these reinforcing raised portion 29*a*, 29*b*, 29*d*. Therefore, the internal reinforcing plate 41, which is provided at the aforementioned one lateral end and used for mounting the hinge, is fixed between the outer panel 21 and the reinforcing raised, portion 29*a* at the one lateral end of the inner panel 23, and the internal reinforcing plate 41*a* at the aforementioned opposing lateral end is fixed between the outer panel 21 and the reinforcing raised portion 29*d* at the opposing lateral end of the inner panel 23.

The internal reinforcing plate 41 is provided at the middle part thereof with a long, narrowly-shaped, grooved reinforcing portion 42. Hinge mounting raised portions 43, 44 with a flat top surface are respectively formed at one end and the opposing end of the grooved reinforcing portion 42. A pair of bolt insertion holes 50 are formed in each hinge mounting raised portion 43, 44. Furthermore, each hinge mounting raised portion 43, 44 is provided, at a middle part thereof between the two bolt insertion holes 50, with a positioning fitting portion 45 in the shape of an indentation.

At the location corresponding to the internal reinforcing plate 41, the inner panel 23 is provided with a long, narrowly-shaped grooved reinforcing portion 47 to be fitted in the grooved reinforcing portion 42 of the internal reinforcing plate 41. The grooved reinforcing portion 47 is formed at the middle part of the reinforcing raised portion 29*a* located at the hinge-attaching end of the inner panel 23. Flat hinge mounting surface portions 48, 49 are respectively formed at one end and the opposing end of the grooved reinforcing portion 47. A plurality of bolt insertion holes 48*h*, 49*h* are formed in each hinge mounting surf ace portion 48, 49. Furthermore, each hinge mounting surface portion 48, 49 is provided, at a middle part thereof, with a positioning fitting portion 51, 52 in the shape of a protrusion in such a direction as to fit to the internal reinforcing plate 41. The positioning fitting portion 51 is formed, between the two bolt insertion holes 48*h*, 48*h*, whereas the positioning fitting portion 52 is formed between the bolt insertion holes 49*h*, 49*h*.

By fitting the positioning fitting portions 51, 52 formed on the hinge mounting surface portions 48, 49 of the inner panel 23 respectively in the positioning fitting portions 45 formed in the hinge mounting raised portions 43, 44 of the internal reinforcing plate 41, the internal reinforcing plate 41 is positioned with respect to the inner panel 23. By thus positioning the internal reinforcing plate 41, the grooved, reinforcing portion 47 of the inner panel 23 is fitted in the grooved reinforcing portion 42 of the internal reinforcing plate 41, and the bolt insertion holes 50 of the internal reinforcing plate 41 and the bolt insertion holes 48*h*, 49*h* of the inner panel 23 are precisely aligned, with each other.

The inner panel 23 includes the frame-like reinforcing raised portion 29*a*, 29*b*, 29*d* formed along and bulging from the adhering portions 27,28, which are in direct contact with the outer panel 21. As illustrated in FIG. 6, a reinforcing deformed portion 56 is formed in a step-like shape along the middle of each sloping side of the frame-like reinforcing raised portion 29*a*, 29*b*, 29*d*, thereby enabling the inner panel 23 to have a raised portion of a sufficient height with respect to the outer panel 21 as well as sufficient strength. To be more specific, the thick, frame-like reinforcing raised portion 29*a*, 29*b*, 29*d* is excellent in cross-sectional characteristics, such as the geometric moment of inertia. Furthermore, in addition to the effect of the reinforcing structure achieved by the reinforcing deformed portions 56 and the reinforcing indentations 30, etc., the frame-like reinforcing raised portion 29*a*, 29*b*, 29*d* is resistant to bending stress and other similar external force and not easily deformed.

The interior the laterally extending reinforcing raised portions 29*b* and the crossbar-shaped reinforcing raised portions 29*c* is filled with the foamed material 24. On the other hand, the interior of the vertically extending reinforcing raised portions, i.e. the reinforcing raised portion 29*a* at the hinge-attaching end and the reinforcing raised portion 29*d* at the lock mechanism-attaching end, is not filled with the foamed material. As a result, the amount of the foaming material as well as the length of labor time, such as the time required for attaching the foaming material, are reduced, while sufficient vibration damping effect of the formed material 24 is maintained.

The reinforcing raised portions 29*a*, 29*d*, which are respectively located at one lateral end and the other lateral end of the crossbar-shaped reinforcing raised portions 29*c*, are bent inward so that the reinforcing raised portion 29*b* that is at the top is angled inward as illustrated in FIG. 5. In order to prevent formation of wrinkles when, the reinforcing raised portions 29*a*, 29*d* are bent, wrinkle preventing indentations 58,59 are respectively formed in the inner surfaces of the reinforcing raised portions 29*a*, 29*d*. The internal reinforcing plate 41, too, is provided with an indentation 60, in which one of the wrinkle preventing indentations of the inner panel 23, i.e. the wrinkle preventing indentation 58, is adapted, to be fitted.

Mounting holes 62 for attaching the lock mechanism are formed in the proximity of the center of the reinforcing raised, portion 29*d*, which is at the end of the inner panel 23 opposite the hinge-attaching end. A mounting opening 63 for attaching a releasing operation mechanism that will be explained later is formed in the lower part of the door panel 20, at a location below the mounting holes 62.

The internal reinforcing plate 41*a* for mounting the lock mechanism is formed of the same material as that of the internal reinforcing plate 41 for mounting the hinge and fixed between the outer panel 21 and the inner panel 23 in the same manner as the internal reinforcing plate 41 for mounting the hinge. On the other hand, the internal reinforcing plate 41*a* is provided with mounting holes 62*a* and a cutout portion 63*a* instead of the hinge mounting raised portions 43, 44. The mounting holes 62*a* serve for mounting the lock mechanism and are formed at the middle part of the internal reinforcing plate 41*a*, at locations respectively corresponding to the mounting holes 62 of the inner panel 23. The cutout portion 63*a* for mounting the releasing operation mechanism is formed at the lower portion of the internal reinforcing plate 41*a*.

Figure 4:
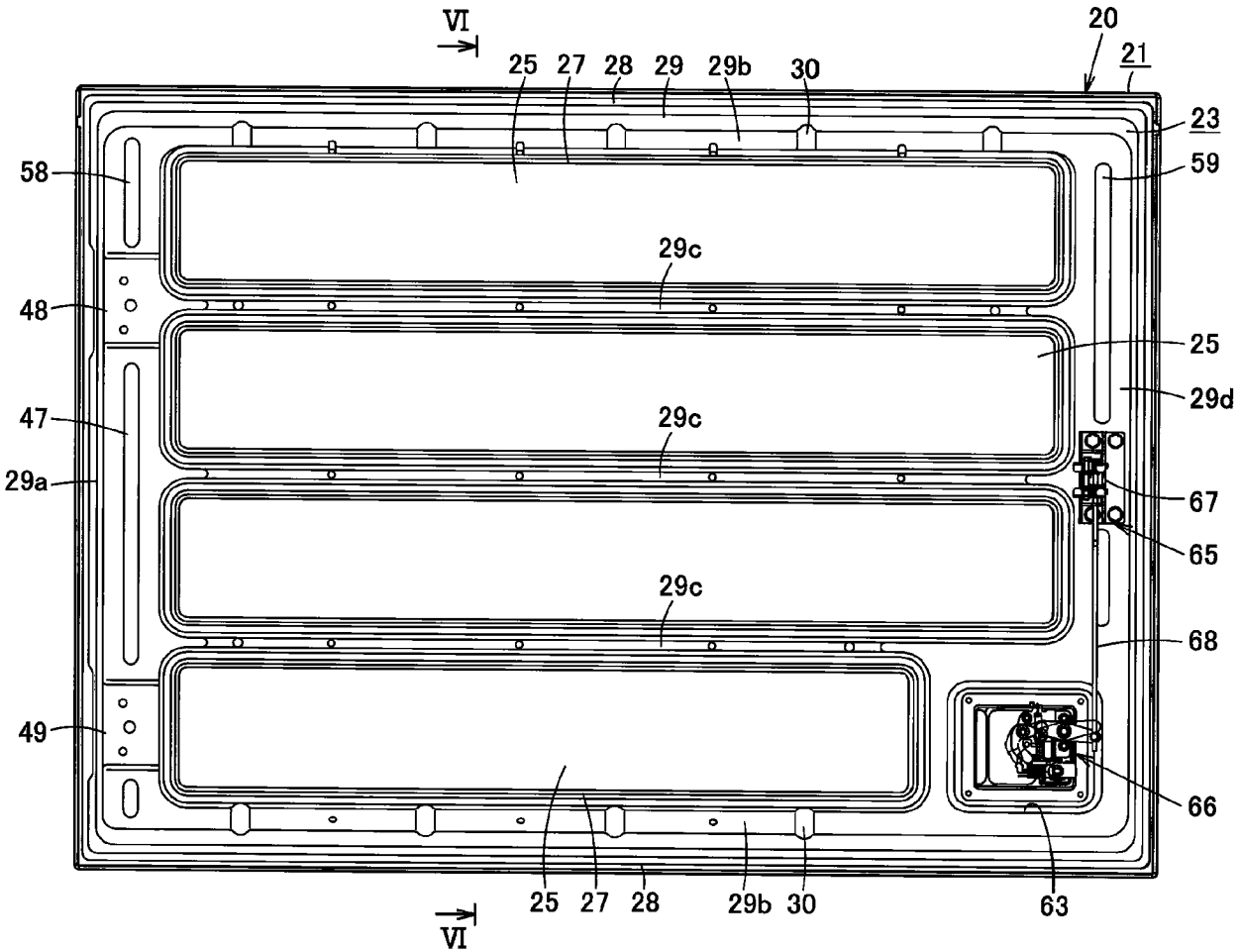
FIG. 4 is a front view of a door panel of the door unit as viewed from the inner side.

As illustrated in FIG. 4, by means of bolts, the latch-like lock mechanism 65 is attached to the middle part of the reinforcing raised portion 29*d*, which is at the end opposite the hinge-attaching end of the inner panel 23 of the door panel 20, through the abovementioned mounting holes for attaching the lock mechanism, i.e. the mounting holes 62 of the inner panel 23 and the mounting holes 62*a* of the internal reinforcing plate 41. The lock mechanism 65 is adapted to engage with or disengage from a striker (not shown) of a frame provided at the machine body, thereby locking or releasing the door panel 20, when the door panel 20 is closed against the frame provided at the machine body.

The mounting opening 63, which is formed at the lower portion of the swinging-end part of the door panel 20, is provided with the aforementioned releasing operation mechanism 66 for releasing the lock mechanism 65 from the locking position. The releasing operation mechanism 66 is linked with a latch 67 of the lock mechanism 65 by means of a rod-shaped link member 68. By means of this link member 68, releasing operation of the releasing operation mechanism 66, which is provided at a location accessible by the operator, is transmitted to the latch 67 of the lock mechanism 65, which is provided at a location difficult for the operator to reach.

When producing a door panel 20 that has the structure described above, the thermosetting adhesive 34 is applied respectively to the joint surfaces between the outer panel 21, the inner panel 23, and the internal reinforcing plates 41, 41*a*. Then, in the state where the outer panel 21, the inner panel 23, and the internal reinforcing plates 41, 41*a* are positioned and fastened to one another by means of hemming along the peripheral edge of the outer panel 21 as illustrated in FIG. 6 as well as by a fixing jig (not shown), the outer panel 21, the inner panel 23, and the internal reinforcing plates 41, 41*a* are placed in a baking finish heating furnace in order to bond the outer panel 21, the inner panel 23, and the internal reinforcing plates 41, 41*a* to one another by hardening the thermosetting adhesive 34 applied to the surfaces between these components.

At that time, the foaming material attached to the inner surface of the outer panel 21 or the inner surface of the inner panel 23 is expanded by heating using the aforementioned baking finish heating furnace so that the space 22 is filled with the foamed material 24. By further heating using the baking finish heating furnace, the paint that, has been sprayed beforehand onto the outer surface of the outer and inner panels 21, 23 is baked thereon.

Figure 3:
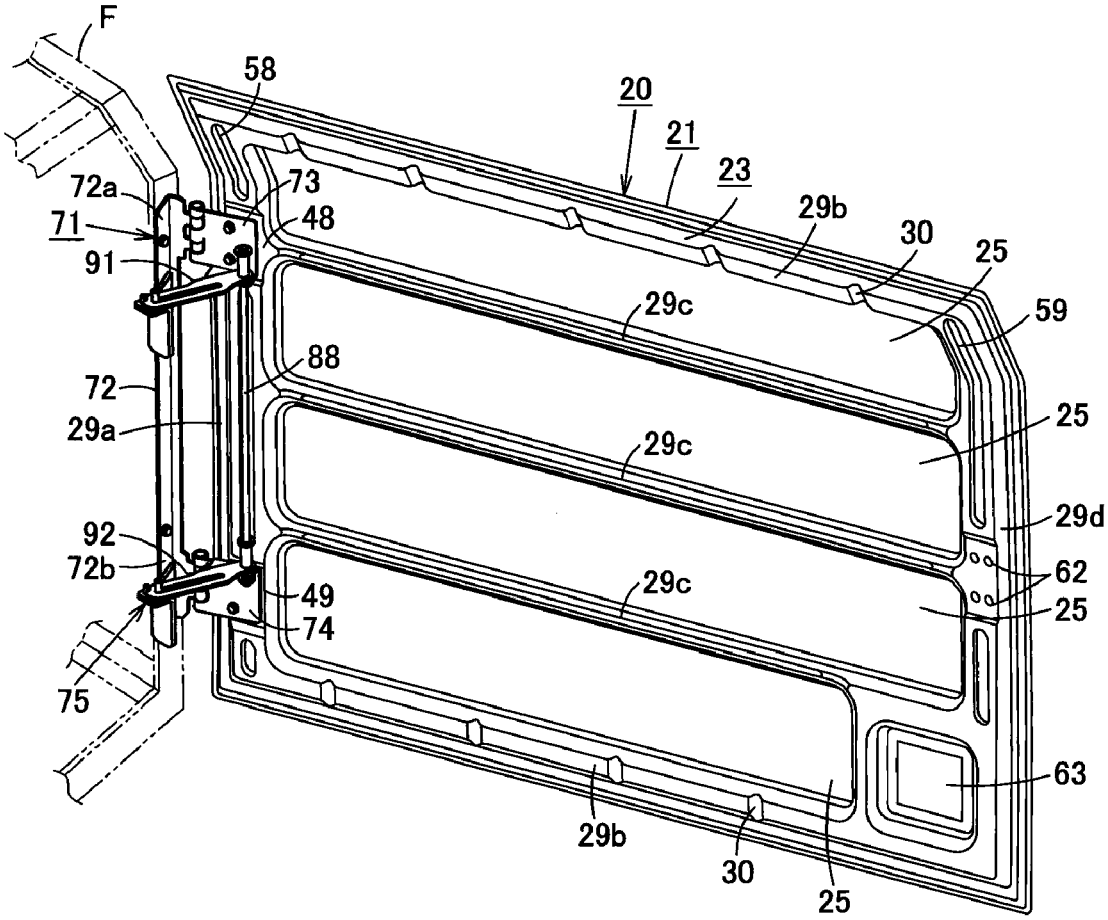
FIG. 3 is a perspective view of an embodiment of a door unit according to the present invention viewed, from the inner side thereof, the door unit being equipped with and adapted to be opened and closed by the hinge.

As illustrated in FIG. 3, a door unit that may be used as the side door 17 or the like is formed by attaching the hinge 71 to the aforementioned one lateral end of the door panel 20 produced as above.

As illustrated in FIG. 3, the hinge 71 is provided, at one of the lateral sides thereof, with a one-side hinge plate 72 and a plurality of one-side hinge plate portions 72*a*, 72*b* that are formed as an integral body with the one-side hinge plate 72. The one-side hinge plate 72 has an elongated shape and is fixed to a frame, i.e. a frame F provided at the machine body. Provided at the opposing side of the hinge 71 are a plurality of opposing-side hinge plate portions 73, 74, which are supported by the one-side hinge plate portions 72*a*, 72*b* and adapted to be freely openable and closable by means of shaft members. In other words, the opposing-side hinge plate portions 73, 74 are provided at a plurality of locations in the lengthwise direction of the one-side hinge plate 72. An open-angle limiting mechanism 75 is provided so as to bridge the opposing-side hinge plate portions 73, 74 to the one-side hinge plate 72 and serve to stop opening motion of the opposing-side hinge plate portions 73, 74 at a specific angle with respect to the one-side hinge plate 72. The opposing-side hinge plate portions 73, 74 are respectively attached to the hinge mounting surface portions 48,49 of the inner panel 23 by means of bolts.

Figure 1:
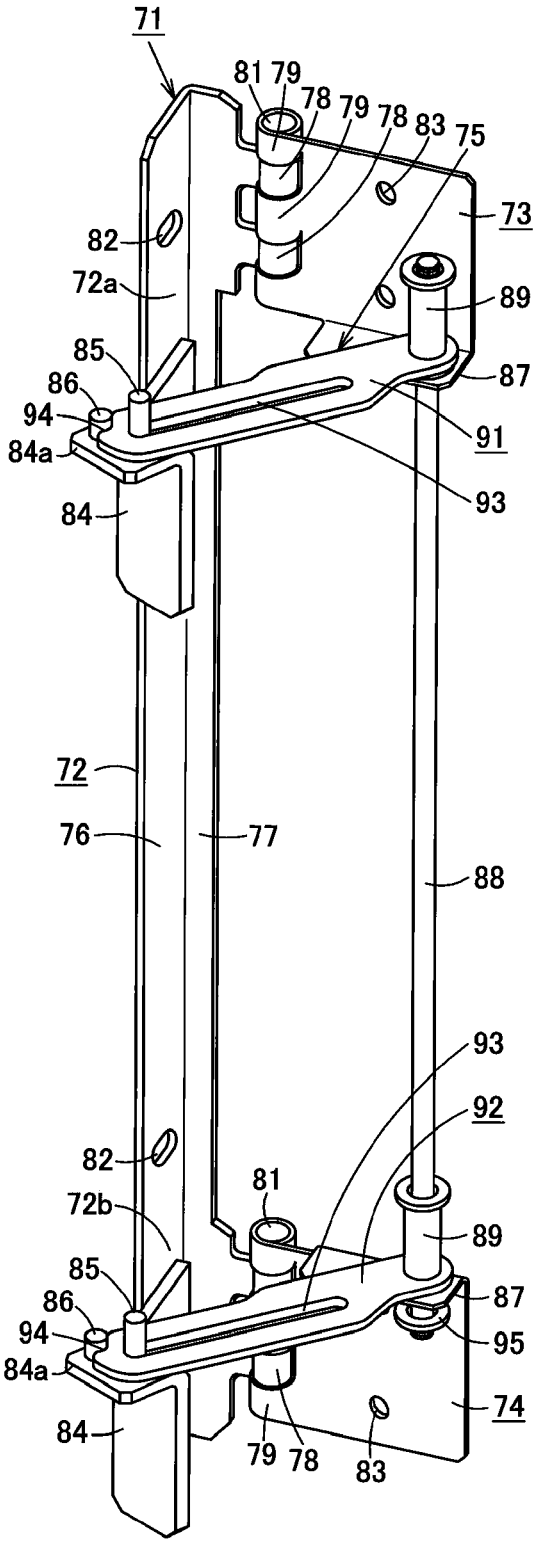
FIG. 1 is a perspective view of an embodiment of a hinge according to the present invention in the state where the door is held open.
Figure 2:
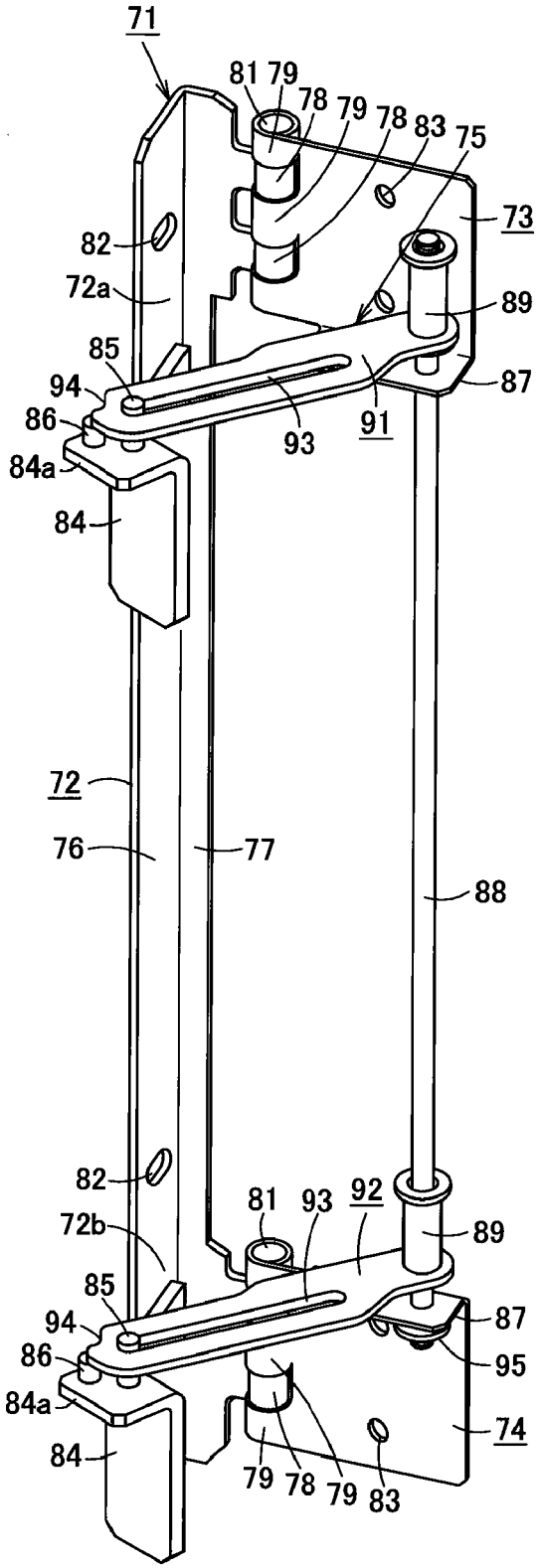
FIG. 2 is a perspective view of the hinge in the released state.

As illustrated, in FIGS. 1 and 2, the one-side hinge plate 72 includes a flat frame-contact plate portion 76 and a shaft-bearing plate portion 77, which is bent at an angle to the frame-contact plate portion 76. A plurality of shaft-bearing ring portions 78 are provided at each vertical end portion, i.e. the upper end portion and the lower end portion, of the shaft-bearing plate portion 77, as an integral body therewith, at a location corresponding to each respective one-side hinge plate portion 72*a*, 72*b*. A plurality of shaft-bearing ring portions 79 are provided, as an integral body with each one of the plurality of opposing-side hinge plate portions 73, 74. The shaft-bearing ring portions 78 at the upper end portion of the shaft-bearing plate portion 77 are alternately fitted to shaft-bearing ring portions 79 of the opposing-side hinge plate portion 73, and the shaft-bearing ring portions 78 at the lower end portion of the shaft-bearing plate portion 77 are alternately fitted to shaft-bearing ring portions 79 of the opposing-side hinge plate portion 74. A shaft member 81 is inserted, into an each, set of shaft-bearing ring portions 78,79 fitted to one another.

Mounting holes 82 for receiving a plurality of mounting-bolts are formed in the frame-contact plate portion 76 of the one-side hinge plate 72. By means of fastening bolts inserted in the mounting holes 82, the one-side hinge plate 72 is fastened to the frame F at the machine body as illustrated in FIG. 3. Furthermore, bolt insertion holes 83 for fastening the door panel 20 are formed in the upper and lower opposing-side hinge plate portions 73, 74.

The open-angle limiting mechanism 75 includes mounting plate portions 84, horizontal mounting plate portions 84*a*, a plurality of guide members 85, a plurality of lock members 86, a plurality of bracket portions 87, a rod 88, mounting cylinder portions 89, and a plurality of hold-stay members 91, 92. The mounting plate portions 84 are welded or otherwise integrally fixed to the one-side hinge plate 72, at a plurality of locations in the lengthwise direction of the one-side hinge plate 72. Each horizontal mounting plate portion 84*a* is formed by horizontally bending the upper end portion of each respective mounting plate portion 84 and is provided thereon with one each of the aforementioned guide members 85 and lock members 86. The guide member 85 and the lock member 86 on each horizontal mounting plate portion 84*a* are provided in proximity to each other and both are formed in a pin-like shape, with the lock member 86 being shorter than the guide member 85. Each bracket portion 87 has a shaft hole and is provided as an integral body with each respective opposing-side hinge plate portion 73, 74. The rod 88 is rotatably inserted through the shaft holes of these bracket portions 87 in such a manner as to be capable of sliding in the axial direction. The hold-stay members 91, 92 are integrally connected to the rod 88 through the mounting cylinder portions 89, respectively.

Each one of the plurality of hold-stay members 91, 92 has a slit-like fitting portion 93 and a notch-like catching portion 94. The fitting portions 93 of the hold-stay members 91, 92 are adapted to respectively fit around the pin-shaped guide members 85 and, in this state, slide as the opposing-side hinge plate portions 73, 74 are opened or closed with respect to the one-side hinge plate 72. The catching portions 94 can engage with and disengage from the short, pin-shaped lock members 86 as a result of axial movement of the rod 88 when the opposing-side hinge plate portions 73, 74 are at the maximum-open position with respect to the one-side hinge plate 72.

Attached to the lower end of the rod 88 is a stopper portion 95 adapted to be stopped by the bottom surface of the bracket portion 87 of the opposing-side hinge plate portion 74 so that the stopper portion 95 limits the amount of upward movement of the rod 88 in order to ensure that the pin-shaped guide members 85 are always fitted in the slit-like fitting portions 93.

Figure 7:
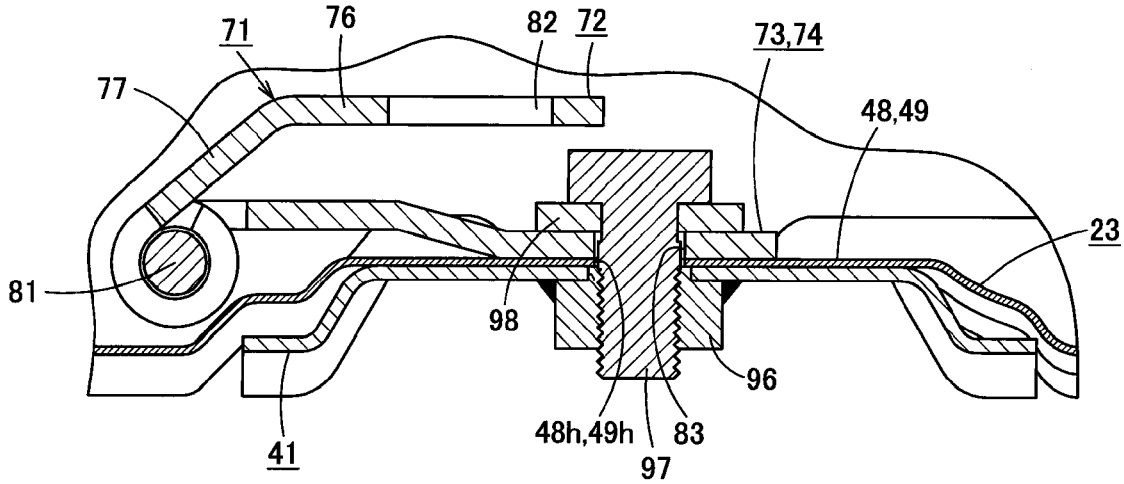
FIG. 7 is a sectional view of the part of the door panel to which the hinge is attached.

FIG. 7 illustrates how the hinge 71 is attached to the door panel 20. The internal reinforcing plate 41 is positioned between and bonded to the outer panel (not shown) and the one lateral end portion of the inner panel 23. By means of nuts 96 welded to the reverse surface of the internal reinforcing plate 41 and bolts 97 screwed in the nuts 96, the opposing-side hinge plate portions 73, 74 of the hinge 71 on the hinge mounting surface portions 48, 49 of the inner panel 23 are fastened. A washer 98 is provided between each opposing-side hinge plate portion 73, 74 and the head of each bolt 97.

The bolts 97 inserted, through the bolt insertion holes 83 of the hinge 71 and the bolt insertion holes 48*h*, 49*h*, which are formed in the hinge mounting surface portions 48, 49 of the inner panel 23, are screwed in nuts 96 through the aforementioned washers 98. The nuts 96 are integrated with the reverse surface of the internal reinforcing plate 41. Thus, the opposing-side hinge plate portions 73, 74 of the hinge 71 are fastened to the door panel 20.

Figure 8:
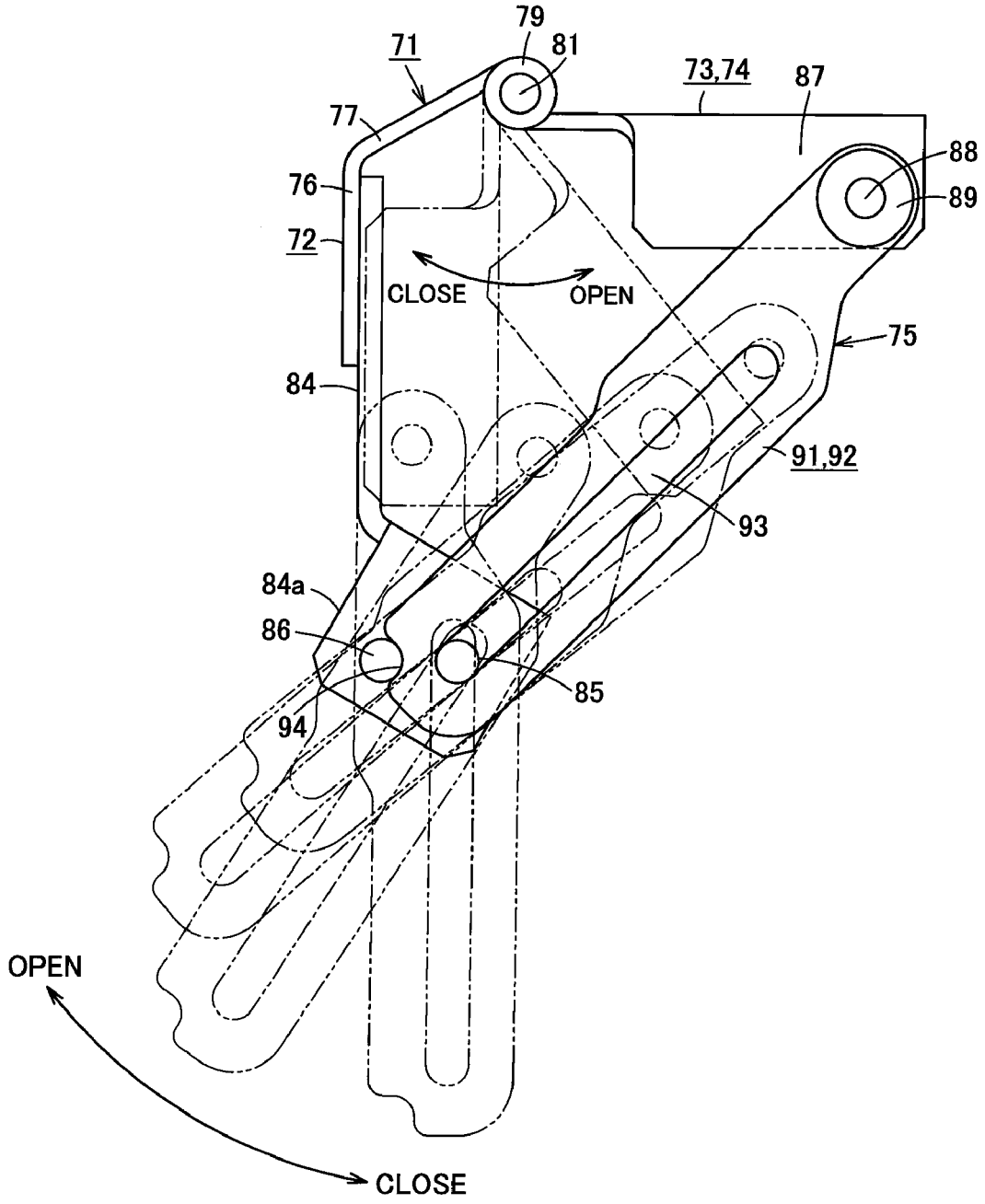
FIG. 8 is a plan view illustrating the movement of an open-angle limiting mechanism of the hinge.

Next, the functions and effects of the embodiment illustrated in FIGS. 1 to 7 are explained hereunder, referring to FIG. 8.

FIG. 8 illustrates a sequence of movements of the hinge 71 when the door panel 20 is opened or closed. As illustrated in FIG. 8, when the door panel 20 is being opened, the upper and lower hold-stay members 91, 92 pivot around the rod 88 while the slit-like fitting portions 93 formed in the hold-stay members 91, 92 slide in the state that, the guide members 85 of the one-side hinge plate 72 are respectively fitted in the fitting portions 93. At that time, the hold-stay members 91, 92 slide on the upper surface of the short, pin-shaped lock members 86.

When the door panel 20 is open, to its fullest extent, the hold-stay members 91, 92 fall, due to their own weight, onto the horizontal mounting plate portions 84*a* of the mounting plate portions 84 so that the catching portions 94 of the hold-stay members 91, 92 engage with the short, pin-shaped lock members 86 as illustrated in FIG. 2 and then as illustrated in FIG. 1. In this state, as illustrated by solid lines in FIG. 8, opening or closing operation of the opposing-side hinge plate portions 73, 74 with respect to the one-side hinge plate 72 is automatically prevented, because the hold-stay members 91, 92 are immovably sandwiched between the guide members 85 and the lock members 86. In other words, opening or closing operation of the door panel 20, which is fastened to the opposing-side hinge plate portions 73, 74, is automatically locked.

When releasing the fully open door panel 20 from the locked state, the operator pushes up the lower hold-stay member 92 or the bottom of the rod 88, either of which, can be reached by hand. At that time, both the hold-stay member 92 and the hold-stay member 91, which moves together with the hold-stay member 92 through the rod 88, move upward as illustrated in FIG. 1 and then as illustrated in FIG. 2. As a result, the catching portions 94 of the hold-stay members 91, 92 move upward, so as to disengage from the short, pin-shaped lock members 86, thereby enabling the opposing-side hinge plate portions 73, 74 to be moved in the closing direction while the hold-stay members 91, 92 slide on the upper surface of the lock members 86. In other words, the door panel 20, which is fastened to the opposing-side hinge plate portions 73, 74, can be closed.

As described above, the open-angle limiting mechanism 75 serves to stop, at a specific angle, opening movement of the plurality of opposing-side hinge plate portions 73, 74, which are respectively provided at a plurality of locations in the lengthwise direction of the one-side hinge plate 72 having an elongated shape, and supported by the one-side hinge plate 72 so as to be freely openable and closable. The mounting plate portions 84 are provided as an integral body with the one-side hinge plate 72, respectively at a plurality of locations in the lengthwise direction of the one-side hinge plate 72. The bracket portions 87 are provided as an integral body with the opposing-side hinge plate portions 73, 74, respectively. The open-angle limiting mechanism 75 is provided with a plurality of hold-stay members 91, 92, each of which extends between each mounting plate portion 84 and the corresponding bracket portion 87. Therefore, even if the door is wide or heavy, the plurality of hold-stay members 91, 92 are capable of supporting the force that is applied in such a direction as to open or close the door without being deformed, resulting in an improved durability of the hold-stay members 91, 92. Furthermore, these hold-stay members 91, 92 are integrally connected to the rod 88, which is rotatably inserted through the shaft, holes of the plurality of bracket portions 87 in such a manner as to be capable of sliding in the axial direction. Therefore, the upper hold-stay member 91, which is difficult to reach, can easily be released from the locked position by operating, for example, the bottom of the rod 88 or the lower hold-stay member 92 in the axial direction of the rod 88.

A particular benefit of the embodiment, described above lies in that the plurality of hold-stay members 91, 92 are provided, with the slit-like fitting portions 93 and the notch-like catching portions 94, wherein the fitting portions 93 are adapted to respectively fit around the pin-shaped, guide members 85 and, in this state, slide as the opposing-side hinge plate portions 73, 74 are opened or closed with respect to the one-side hinge plate 72; and axial movement of the rod 88 when the opposing-side hinge plate portions 73, 74 are at the maximum-open position with respect to the one-side hinge plate 72 causes the catching portions 94 to engage with or disengage from the short, pin-shaped lock members 86, which are respectively provided in the proximity of the guide members 85. With the structure as above, the catching portions 94 of the plurality of hold-stay members 91, 92 are capable of automatically engaging with the plurality of lock members 86 at the aforementioned maximum-open position, thereby automatically maintaining the fully-open position. Furthermore, this structure also makes it possible to simultaneously move the plurality of hold-stay members 91, 92 in the axial direction so as to disengage the hold-stay members 91, 92 from, the plurality of lock members 86 by means of a single member, i.e. the rod 88. Therefore, the structure described above facilitates engagement and disengagement of the plurality of hold-stay members 91, 92.

Furthermore, by using the one-side hinge plate 72 having an elongated shape, the plurality of one-side hinge plate portions 72*a*, 72*b* are formed, as an integral body, and the plurality of mounting plate portions 84 are integrally fixed to the one-side hinge plate 72, respectively at a plurality of locations in the lengthwise direction of the one-side hinge plate 72. With the configuration as above, the plurality of one-side hinge plate portions 72*a*, 72*b* can be fastened easily without the need of adjusting the relative positions therebetween.

As the open-angle limiting mechanism 75 can be formed in a simple structure composed of the pin-shaped guide members 85 and lock, members 86, the slit-shaped fitting portions 93, and the notch-shaped catching portions 94, the open-angle limiting mechanism 75 can easily be produced.

With regard to the door panel 20, the hollow structure with a closed cross section formed of the outer panel 21 and the inner panel 23, which is thinner than the outer panel 21, can make the entire door panel 20 lighter. Furthermore, as the closed cross section of this hollow structure has sufficient height, being formed of the inner panel 23 and the outer panel 21 with a thickness greater than that of the inner panel 23, the door panel 20 has sufficient strength against an external impact. Therefore, the embodiment is capable of inexpensively providing a door panel that is light in weight and has sufficient strength. Moreover, the foamed material 24 filling the space between the outer panel 21 and the inner panel 23 is capable of effectively damping sound generated from the door panel 20 itself and, consequently, effectively reducing noise.

As the space between the outer panel 21 and the inner panel 23 is filled with the foamed material 24 in order to make the door panel 20 lighter as well as improve the vibration absorbing ability of the door panel 20, the burden imposed on the hinge 71 is particularly reduced, resulting in improved durability of the hinge 71.

Figure 10:
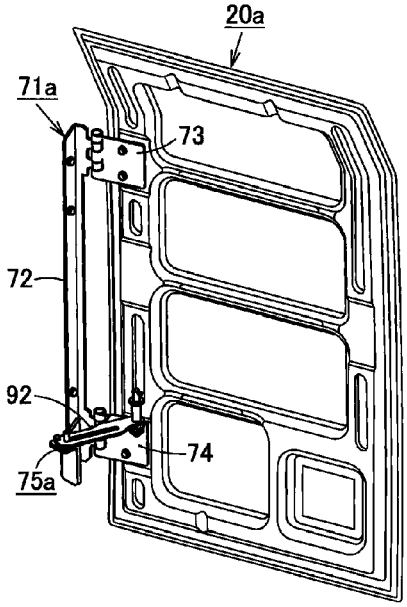
FIG. 10 is a perspective view of the door unit illustrating an example where the lower part of the hinge alone is provided with the open-angle limiting mechanism.
Figure 11:
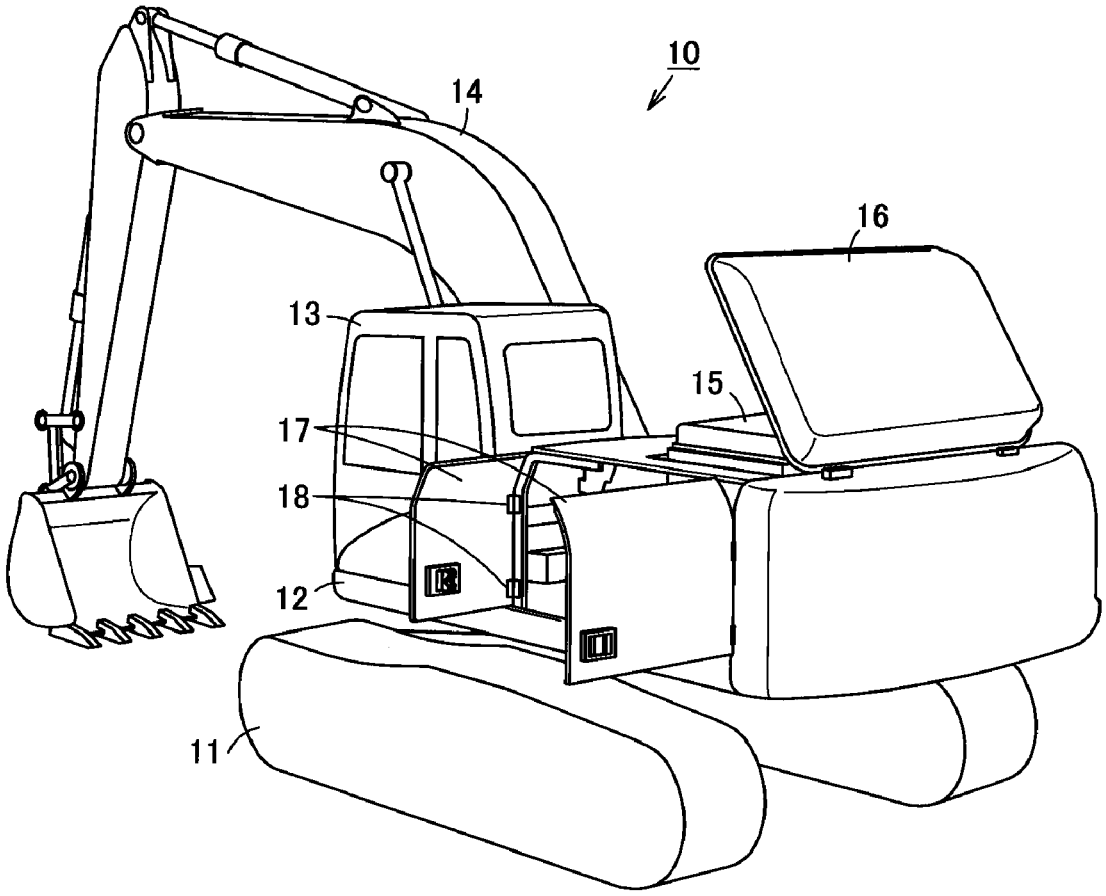
FIG. 11 is a perspective view of a work machine equipped with a conventional door unit.
Figure 12:
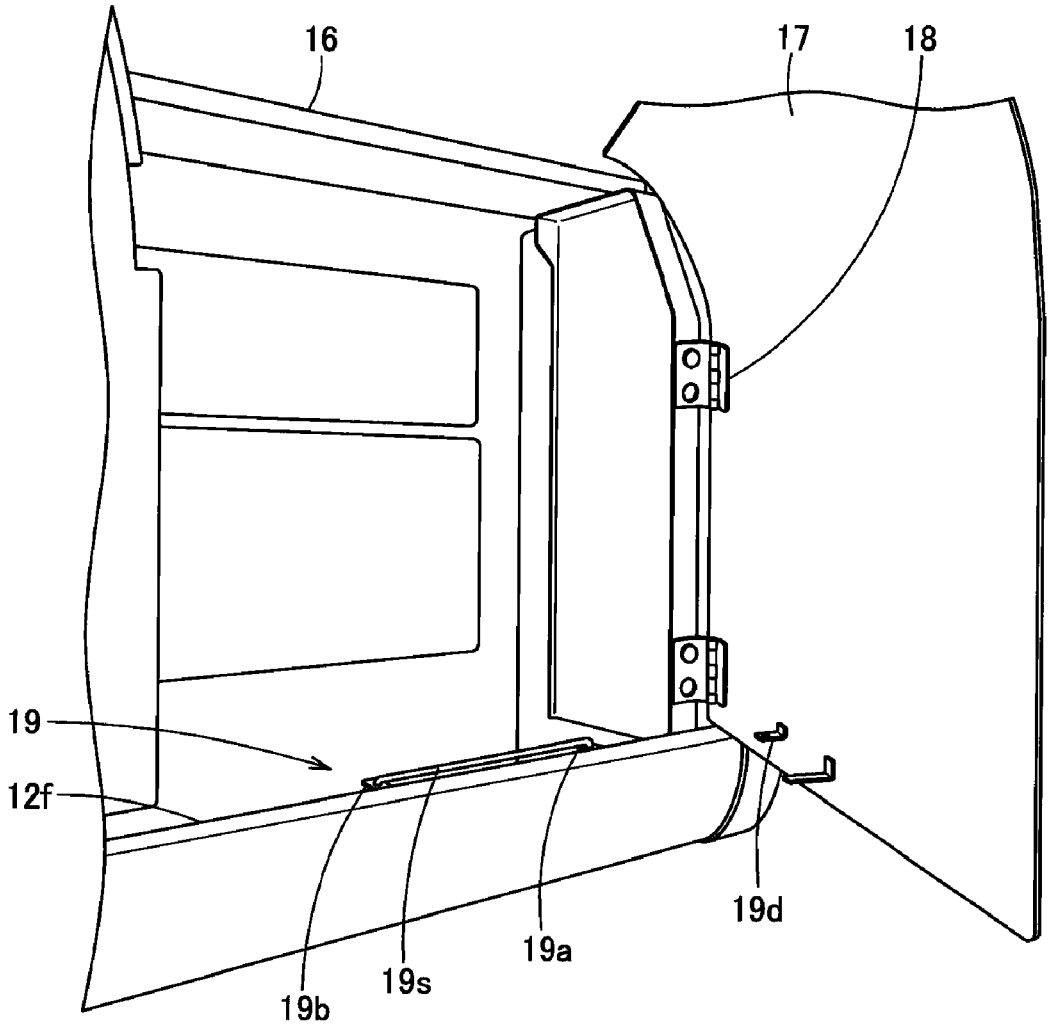
FIG. 12 is a perspective view of the conventional door unit in the state where the door is open.
Figure 13:
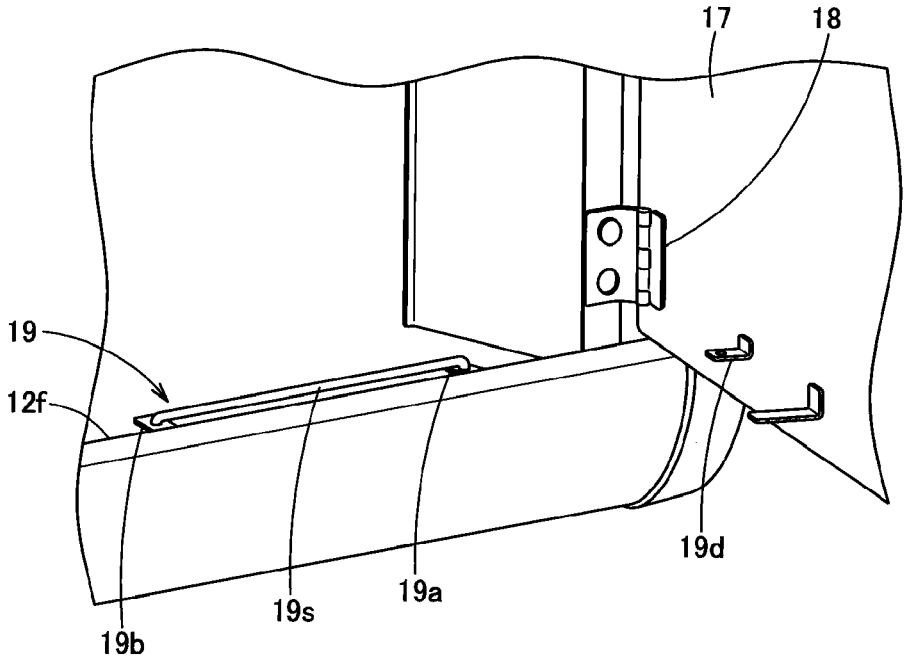
FIG. 13 is a perspective view of a holding mechanism of the conventional door unit in the state where the holding mechanism is in a stowed position.
Figure 14:
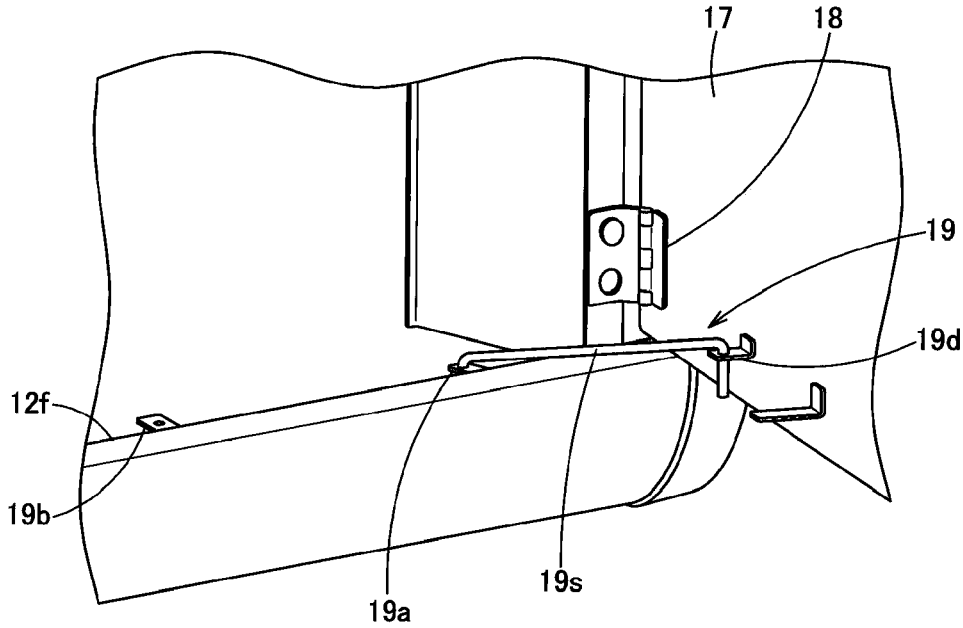
FIG. 14 is a perspective view of the holding mechanism of the conventional door unit in the state where the holding mechanism is in use.

FIG. 10 illustrates a hinge 71*a* used for a door panel 20*a* that has a narrow width or is light in weight. The hinge 71*a* includes an open-angle limiting mechanism 75*a* of which only the lower opposing-side hinge plate portion 74, which is within the reach of the operator, is provided with a hold-stay member 92. Without the necessity of a major change in the design, the open-angle limiting mechanism 75*a* can be produced by modifying the open-angle limiting mechanism 75 illustrated in various drawings including FIG. 1 so that only a single hold-stay member 92 is provided.

A hinge and a door unit according to the present invention are applicable to a side door, a rear door, an engine hood, or the like of a work machine, such as a hydraulic excavator.

The invention claimed is:

1. A hinge comprising:

a plurality of one-side hinge plate portions at one side of the hinge;

a plurality of opposing-side hinge plate portions provided at the opposing side of the hinge and supported by the one-side hinge plate portions so as to be freely openable and closable; and an open-angle limiting mechanism provided so as to bridge the opposing-side hinge plate portions to the one-side hinge plate portions and stop opening movement of the opposing-side hinge plate portions at a specific angle with respect to the one-side hinge plate portions; wherein:

the open-angle limiting mechanism includes:

mounting plate portions respectively provided at the one-side hinge plate portions as an integral body therewith, a plurality of guide members respectively provided at the mounting plate portions, a plurality of lock members that are shorter than the guide members and respectively provided in proximity to the guide members, a plurality of bracket portions respectively provided at the opposing-side hinge plate portions as an integral body therewith and having shaft holes, a rod rotatably inserted through the shaft holes of the bracket portions in such a manner as to be capable of sliding in the axial direction, and a plurality of hold-stay members integrally connected to the rod; and each one of the plurality of hold-stay members includes:

a fitting portion adapted to fit to each respective guide member and, in this state, slide as a result of opening or closing operation of the opposing-side hinge plate portions with respect to the one-side hinge plate, and a catching portion that is adapted to engage with or disengage from each respective lock member as a result of axial movement of the rod when the opposing-side hinge plate portions are at a maximum-open position with respect to the one-side hinge plate portions.

2. A hinge as claimed in claim 1, wherein:

the hinge includes a one-side hinge plate having an elongated shape;

the plurality of one-side hinge plate portions are formed as an integral body with the one-side hinge plate; and the plurality of mounting plate portions are formed as an integral body with the one-side hinge plate, respectively at a plurality of locations in the lengthwise direction of the one-side hinge plate.

3. A hinge as claimed in claim 1, wherein:

each of the guide members and lock members has a pin-like shape;

the fitting portion of each hold-stay member has a slit-like shape; and the catching portion of each hold-stay member has a notch-like shape.

4. A door unit comprising:

a door panel;

a hinge as claimed in claim 1, the hinge serving to attach one end of the door panel to a frame, wherein the door panel comprises:

an outer panel, an inner panel affixed to the inner surface of the outer panel so that a space is formed between the outer panel and the inner panel, and a foamed material filling the space between the outer panel and the inner panel.

* * * * *